US009968198B2

(12) United States Patent
Hauer

(10) Patent No.: US 9,968,198 B2
(45) Date of Patent: May 15, 2018

(54) CONTOURED TRAVEL PILLOW

(71) Applicant: HauerDesigns LLC, Cincinnati, OH (US)

(72) Inventor: Jeff L. Hauer, Cincinnati, OH (US)

(73) Assignee: HauerDesigns LLC, Cincinnati, OH (US)

( * ) Notice: Subject to any disclaimer, the term of this patent is extended or adjusted under 35 U.S.C. 154(b) by 213 days.

(21) Appl. No.: 14/765,434

(22) PCT Filed: Feb. 4, 2014

(86) PCT No.: PCT/US2014/014611
§ 371 (c)(1),
(2) Date: Aug. 3, 2015

(87) PCT Pub. No.: WO2014/121258
PCT Pub. Date: Aug. 7, 2014

(65) Prior Publication Data
US 2016/0007756 A1 Jan. 14, 2016

Related U.S. Application Data

(60) Provisional application No. 61/760,532, filed on Feb. 4, 2013.

(51) Int. Cl.
*A47C 7/38* (2006.01)
*A47G 9/10* (2006.01)
(Continued)

(52) U.S. Cl.
CPC ..... *A47C 7/383* (2013.01); *A47C 7/36* (2013.01); *A47C 7/38* (2013.01); *A47G 9/10* (2013.01);
(Continued)

(58) Field of Classification Search
CPC .. A47C 7/36; A47C 7/38; A47C 7/383; A47C 1/036; A47G 9/10; A47G 9/1054;
(Continued)

(56) References Cited

U.S. PATENT DOCUMENTS 16,300 A * 12/1856 Wilson ..... A47C 7/383
128/DIG. 23
98,859 A * 1/1870 Fast ..... A47C 7/383
297/393
(Continued)

FOREIGN PATENT DOCUMENTS

GB 2313050 11/1997

OTHER PUBLICATIONS

International Search Authority/US , International Search Report, Written Opinion of the International Searching Authority, dated May 21, 2014, Alexandria, Virginia.
(Continued)

*Primary Examiner* — Nicholas F Polito
*Assistant Examiner* — David R Hare
(74) *Attorney, Agent, or Firm* — Wood Herron & Evans LLP

(57) ABSTRACT

A travel pillow includes a pliable body which conforms to a user's shoulder and neck, and an anchor which extends from a forward portion of an outer surface of the body to a rearward portion thereof. Opposite ends of the anchor include connectors, each connector adapted to releasably hold one end of a strap. By positioning the body on one shoulder of the user, adjacent to the head, and with one end of the strap removably connected to a rearward portion of the body, the user may extend the other end of the strap around his/her torso and firmly hold the strap, so as to apply a pulling force on the anchor via the strap. This pulling force
(Continued)

applied via the strap and the anchor enables the pillow to remain in place to support the head of the user.

18 Claims, 5 Drawing Sheets

(51) Int. Cl.
*A47C 7/36* (2006.01)
*A45C 13/30* (2006.01)

(52) U.S. Cl.
CPC ..... *A47G 9/1027* (2013.01); *A47G 9/1072* (2013.01); *A47G 9/1081* (2013.01); *A45C 2013/306* (2013.01); *A47G 2009/1018* (2013.01)

(58) Field of Classification Search
CPC ..... A47G 9/1081; A47G 9/109; A47G 2009/1018; A47G 9/1072; A47G 9/1027; A45C 2013/306
See application file for complete search history.

(56) References Cited

U.S. PATENT DOCUMENTS 1,579,585 A * 4/1926 Wieder ..... A47C 7/383 297/392
4,097,086 A * 6/1978 Hudson ..... A47C 7/383 297/217.1
4,617,691 A * 10/1986 Monti ..... A47C 7/383 128/DIG. 23
4,679,262 A * 7/1987 Davis ..... A47C 7/383 297/391
D369,666 S * 5/1996 Lucero ..... D24/183
5,611,601 A * 3/1997 Cowgur ..... A47C 7/383 297/393
D396,594 S * 8/1998 Lefebvre ..... D6/601
D404,238 S * 1/1999 Keilhauer ..... D6/601
6,042,185 A * 3/2000 Cowgur ..... A47C 7/383 297/393
6,484,335 B2 * 11/2002 Gilbert ..... A47C 7/383 297/397
6,748,615 B1 * 6/2004 Tiedemann ..... A47C 7/383 297/397
6,859,965 B1 * 3/2005 Gourd ..... A47C 7/383 297/393
6,957,462 B1 * 10/2005 Wilcox ..... A47C 7/383 297/393
6,973,691 B1 * 12/2005 Cordova ..... A47C 7/383 248/118
D534,389 S * 1/2007 Chisholm ..... A47C 7/383 D6/601
D614,901 S * 5/2010 Welch ..... D6/601
7,722,122 B2 * 5/2010 Mittelstadt ..... A47C 7/383 297/397
7,758,125 B2 * 7/2010 Mittelstadt ..... B60N 2/4879 297/397
7,788,751 B1 * 9/2010 Diemer ..... A47C 7/383 297/391
7,908,692 B2 * 3/2011 Lange ..... A47C 7/383 5/636
8,321,977 B1 * 12/2012 Kummerfeld ..... A47D 13/00 248/118
8,322,343 B2 * 12/2012 Cardin ..... A61G 7/0755 128/845
8,333,308 B2 * 12/2012 Maginness ..... A45F 3/04 224/153
8,708,416 B2 * 4/2014 Stronconi ..... B60N 2/4805 297/397
9,408,471 B2 * 8/2016 Higa ..... A47C 7/383
9,737,158 B2 * 8/2017 Kreppein ..... A47G 9/1081
2015/0107025 A1 * 4/2015 Dauphin ..... A47C 7/383 5/638

OTHER PUBLICATIONS

International Bureau of WIPO, International Preliminary Report on Patentability, Written Opinion of the International Searching Authority, dated Aug. 4, 2015, Geneva, Switzerland.

* cited by examiner

CONTOURED TRAVEL PILLOW

RELATED APPLICATIONS

This application claims priority to U.S. Provisional Application No. 61/760,532, entitled "Compact Contoured Anchor Travel Pillow," filed on Feb. 4, 2013, and also PCT Application No. PCT/US2014/014611, filed on Feb. 4, 2014, with the same title, both of which are expressly incorporated by reference herein, in their entirety.

FIELD OF THE INVENTION

This invention relates to a contoured travel pillow that is particularly suited for travel on an airplane.

BACKGROUND OF THE INVENTION

Various types of travel pillows are already known. For instance, U.S. Pat. No. 6,957,462, entitled "Pillow With Slidable Strap Through It" discloses an elongated pillow with an interior adapted to slidably accommodate a strap. The strap can releasably attach the pillow to a portion of the user's body, via connectors, at the ends of the strap.

U.S. Pat. No. 7,908,692, entitled "Support For Supporting The Neck And Head Of A Human Being," discloses a support for supporting the neck and head of an individual. More particularly, this patent discloses a travel pillow for supporting the individual's neck and head in a high-backed seat, in a bed, or on a hard surface, by using right and left elongated support members which support right and left portions of the back, head and neck, respectively. Each of the support members, and an intermediate section, is sufficiently bendable to conform to the natural contours of the left and right neck and head portions of the individual.

U.S. Pat. No. 5,975,638, entitled "Pillow For Sleeping Upright In A Chair," discloses a dual unit which adjustably supports a user's head, to prevent the user from slumping either too much forward or too much to either side. The dual unit secures to the top end of a chair.

U.S. Design Pat. No. D534,389, entitled "Travel Pillow," discloses a contoured travel pillow which is shaped somewhat similar to a football, with opposite ends of a strap attached to opposite sides of the pillow. The strap extends around the torso of the user.

U.S. Pat. No. 5,860,177, entitled "Adjustable Travel Pillow," discloses an adjustable travel pillow structure having a pillow outer shell, a support frame within the shell and a back supporting arm which connects to the top end of a seat.

U.S. Pat. No. 4,574,412, entitled "L-Shaped Anchored Pillow," discloses an L-shaped pillow and pillow case combined with an anchor structure for retaining the pillow and pillowcase in position on a bed, with one leg of the L-shaped pillow and pillowcase being positioned under the head in a conventional manner and the other leg of the pillow and pillowcase extending longitudinally alongside a person reclining on the bed.

Each of these prior art pillows suffers from one or more disadvantages, including: lack of conformability to a user's head; inability to retain the pillow in a desired position relative to the user; insufficient adaptability for use on different sides of the user; and inconvenience in carrying along on a long trip.

SUMMARY OF THE INVENTION

The present invention overcomes these disadvantages via a travel pillow with a pliable three-dimensional shape that readily conforms to the user on either side of the patient's head, and an anchor that extends through the pliable body between forward and rearward portions of the outer surface, with opposite outer ends of the anchor including connectors. A strap has first and second ends, and at least the first end is releasably connectable to either one of the connectors, to accommodate use of the pillow on either the right or the left shoulder. When the first end is connected to the anchor at the rearward portion of the outer surface, the user holds the second end of the strap to apply a pulling force to the anchor, thereby to retain the pliable body in place on the user's shoulder, adjacent to the head.

The anchor is substantially the same dimension as the pliable body, when the pliable body is uncompressed. This enables the anchor, when in use, to apply a pulling force to the pillow, to help retain it in position.

Generally, the outer surface of the pliable body includes two concave surface portions and at least one convex portion. The first concave portion contacts and conforms to the user's shoulder, while the second concave portion contacts the user's neck, and the convex portion contacts the user's face.

According to one preferred embodiment, the outer surface of the pliable body is defined by an encasement which surrounds an inner core. In another embodiment, the pliable body may be inflatable and deflatable, so as to occupy a smaller volume when not in use.

These and other features and advantages of the present invention will be more readily understood in view of the drawings, which are described below.

DETAILED DESCRIPTION OF THE DRAWINGS

Figure 1:
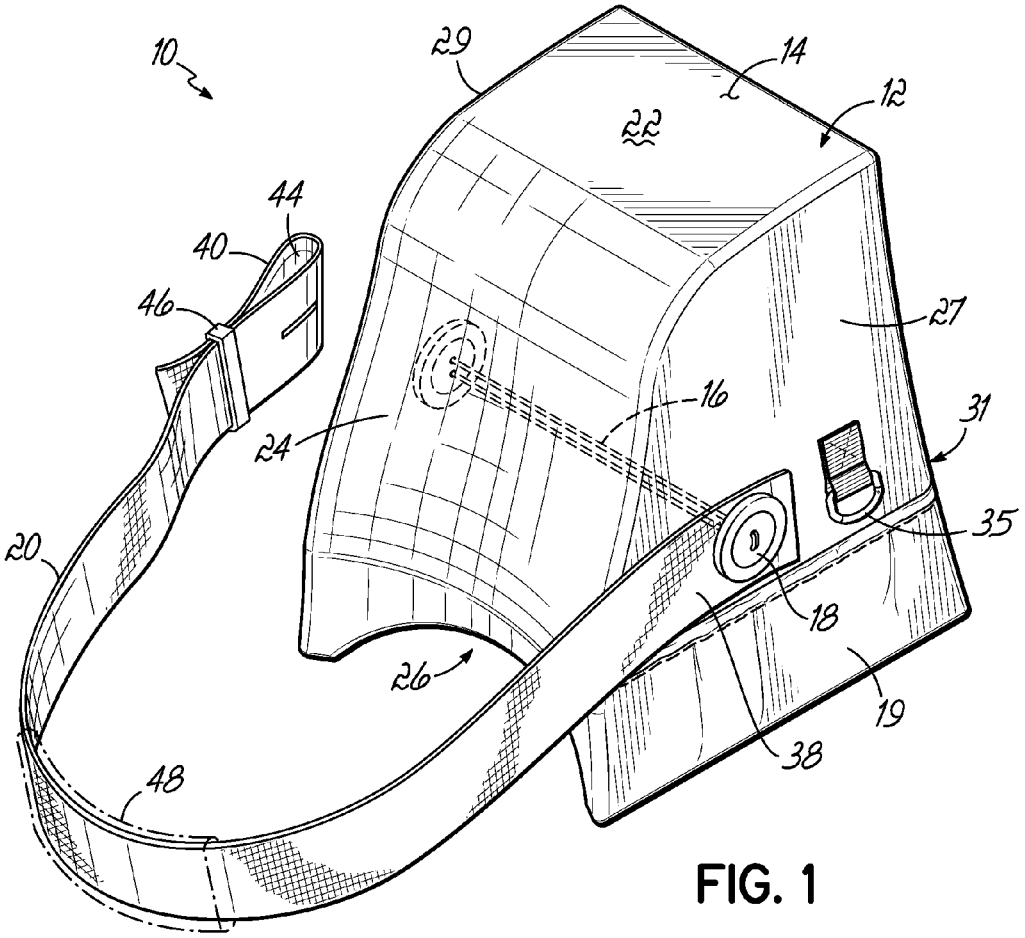
FIG. 1 is a top perspective view of a travel pillow according to a first preferred embodiment of the invention.

FIG. 1 shows a travel pillow 10 constructed in accordance with a first preferred embodiment of the invention. The travel pillow 10 includes a pliable three-dimensional body 12 defined by an outer surface 14. An anchor 16 (shown in phantom) extends through the three-dimensional body 12, extending between opposite outwardly directed surfaces. The outer ends of the anchor 16 include connectors 18, which may be buttons, each of which is releasably connected to a strap 20. The button 18 on one side panel of the pillow 10 is located adjacent, (and in the FIG. 1 above) a pocket 19.

Figure 2:
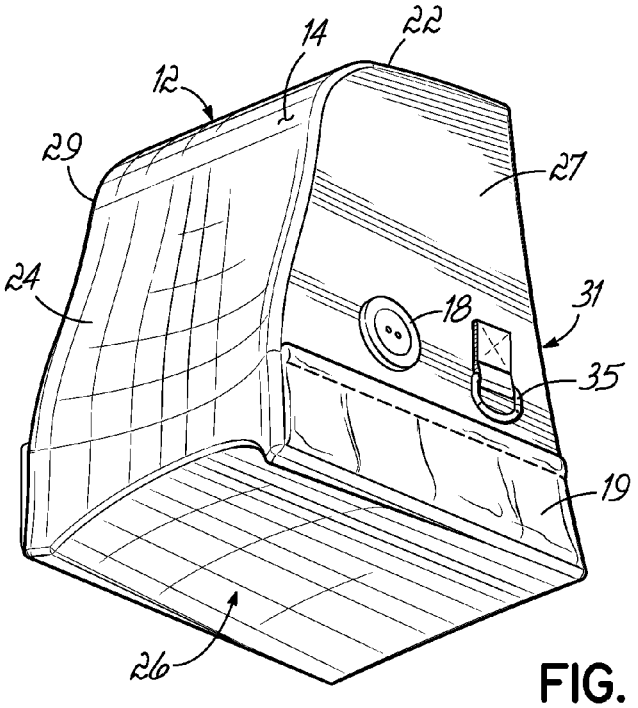
FIG. 2 is a bottom perspective view of the travel pillow shown in FIG. 1, but without the strap.
Figure 3:
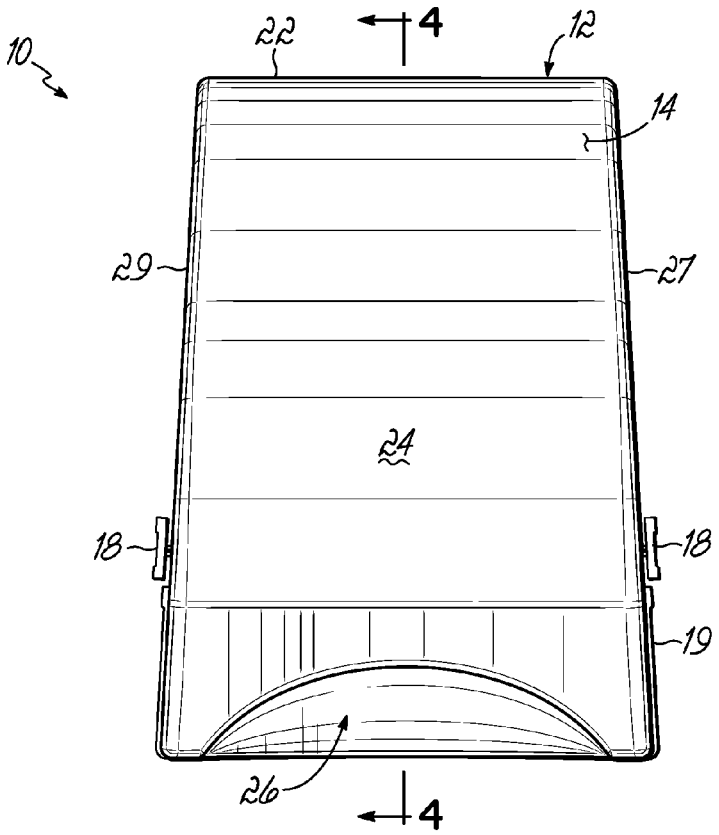
FIG. 3 is a front perspective view of the travel pillow shown in FIG. 1, again without the strap.

The outer surface 14 generally defines contoured sections that are adapted to conform to the head and shoulder of a user, on one side. More specifically, outer surface 14 comprises three centrally located contoured sections 22, 24, 26 (also shown in FIG. 2), and two similar but oppositely located side portions or panels, 27 and 29, and an outwardly directed flat panel or portion 31. Contoured section 22 is a convex in shape and is adapted to generally conform to a user's face. Contoured section 24 is concave in shape and is generally adapted to conform to a user's neck, and contoured section 26 is concave in shape and generally adapted to conform to a user's shoulder. These parts of outer surface 14 can also be seen in FIGS. 3 and 4. Those skilled in the art will appreciate that the invention is amenable to some variation in shape, to comfortably accommodate users of different size and shape, and that the invention is not limited to the particular shape shown and described herein.

Figure 4:
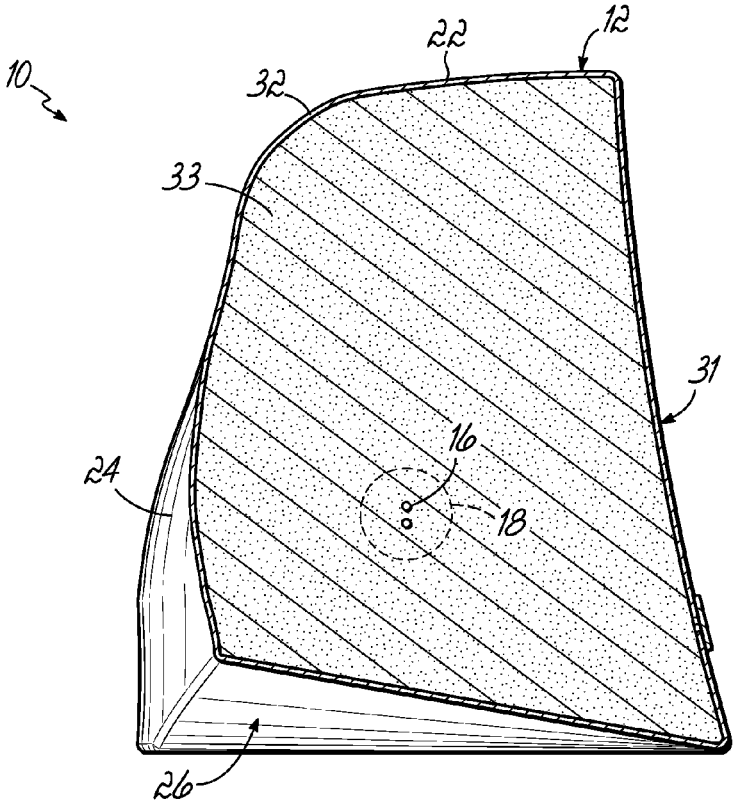
FIG. 4 is a cross-sectional view taken along lines 4-4 of FIG. 3.

FIG. 4 shows that the outer surface 14 of the body 12 is defined by an encasement 32 which surrounds an inner core material 33, which preferably comprises a foam material. Alternatively, the three-dimensional body 12 may comprise any soft pliable material suitable for supporting a user's head. The encasement 32 may be removable, for example by a zipper, velcro, buttons, snaps, etc. In this context, "removable" means that encasement 32 can be easily separated from the inner core material 33, or that the encasement 32 is configured such that it can be separated from the inner core material 33 without causing damage to the pillow 10. In addition to the pocket 19, the encasement 32 may include an accessory securement device 35, (shown in FIG. 1) such as a loop, a strap, or a clip for holding other items.

As described above, and as best shown in FIG. 1, the anchor 16 extends through the pliable three-dimensional body 12 to the two opposing side portions 27 and 29, and each of two outer ends includes a connector 18, in this case a button. The connector 18 could also be a clip, a J hook, a snap, a string, or any other device suitable for releasable connection to the strap 20. As used herein, "releasably connected" means that the connection is not meant to be permanent, and the connection is relatively easily made and unmade manually by the user, and wherein the strap 20 can be attached or removed from connector 18 without causing damage to the travel pillow 10. Typically, the side portions 27 and 29 will face in the "fore" and "aft" direction relative to the use, with one of the portions 27 or 29 facing forwardly and the other 29 or 27 facing rearwardly. If the travel pillow 10 is then moved to the user's other shoulder, the respective directions of the portions would be reversed. But with connectors 18 located on both of panels 27 and 29, the user is always able to connect the first end of the strap 20 to the rearwardly directed panel 27 or 29, regardless of which shoulder the pillow 10 resides on.

Also, anchor 16 has substantially the same length as the pliable three-dimensional body 12, when the body 12 is uncompressed. The phrase "substantially the same length," as used herein, means that the anchor 16 has enough length to extend through the pliable three-dimensional body 12 when uncompressed, but is limited in length such as to create little or no gap between each connector 18 and outer surface 14, and no internal slack. The anchor 16 may be extended through the core 33 by cutting, and then guiding the anchor 16 through the cut, for instance by temporarily securing the distal end of the anchor 16 to an elongated member, such as a knitting needle (not shown). The anchor 16 preferably comprises string, but may alternatively comprise fabric, plastic, leather, or any other material suitable for extending through the pliable body 12 and remaining held in reasonably taut condition by the connectors 18. It is important that the connectors 18 not pull through the encasement 32. Also, inside the pillow 10, the anchor 16 itself is movable relative to the core 33, but that relative movement is limited, because the outer ends of the anchor 16 are bounded by the connectors 18, which remain outside the encasement 32.

The strap 20 releasably connects to one or both of the connectors 18, and thereby enables a user to maintain the pliable three-dimensional body 12 in a desired position on his or her shoulder. More specifically, the strap 20 includes a first end 38 and a second end 40, and first end 38 releasably connects to either connector 18. If desired, the second end 40 of the strap 20 can be configured so as to be releasably attachable to the connector 18. The accompanying Figures show the outer ends 38, 40 of the strap 20 with slots to accommodate the buttons 18. The second end 40 could also have additional slots to allow for adjustability. Alternatively, a different structure could be used to connect the ends of the strap 20 to the connectors 18, so long as the different structure sufficiently cooperates with the connectors 18.

Preferably, the strap 20 includes a loop 44 defined by a length adjuster 46, for adjusting the length of strap 20 and the size of loop 44. The loop 44 enables the user to more readily pull the strap 20, or hold it tight, while the adjustor 46 helps to accommodate different sizes of users, i.e., different arm lengths The length adjuster 46 may comprise any suitable material, such as plastic. Also, strap 20 preferably comprises an elastic material, and also includes at least one padded section 48.

Figure 5:
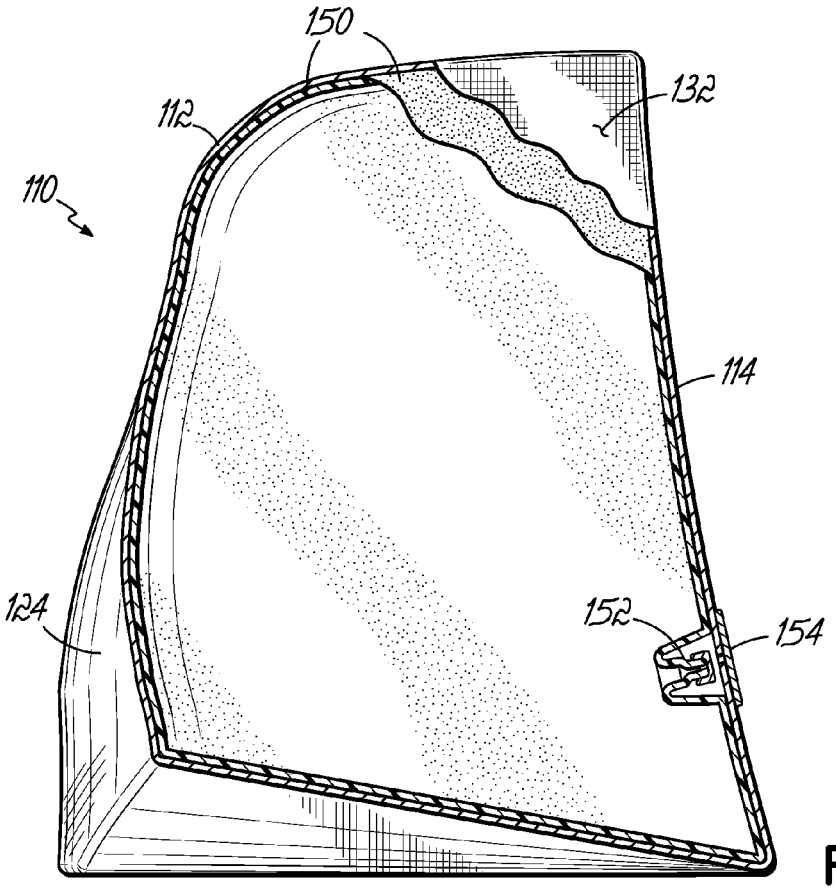
FIG. 5 is a cross-section view, similar to that of FIG. 4, of a travel pillow in accordance with a second preferred embodiment the present invention, wherein the three-dimensional body is deflatable/inflatable.

FIG. 5 shows a second preferred embodiment of the present invention, a travel pillow 110 with a pliable three-dimensional body 112 that is inflatable and deflatable. The three-dimensional body 112 includes an outer encasement 132 which generally is a removable cover, preferably of fabric, which defines an outer surface 114. The encasement 132 surrounds an inflatable/deflatable bladder 150 that is adapted to be filled with air through a valve 152 which may be recessed within the encasement 132 and concealed or exposed by a cover strip 154. This recess could be located within a pocket. The configuration of the bladder 150 and the valve 152 allows a user to inflate the three-dimensional body 112 while in use and to also deflate the three-dimensional body 112 while not in use. This enables the travel pillow 110 to be more conveniently stored, in a smaller volume.

Figure 6:
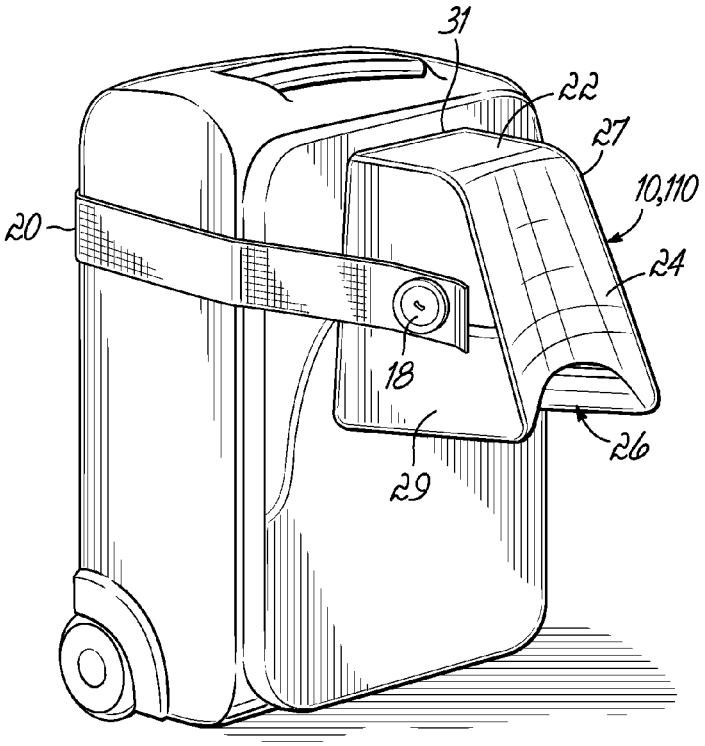
FIG. 6 shows the travel pillow of FIG. 1 in use, in combination with a conventional suitcase.
Figure 7:
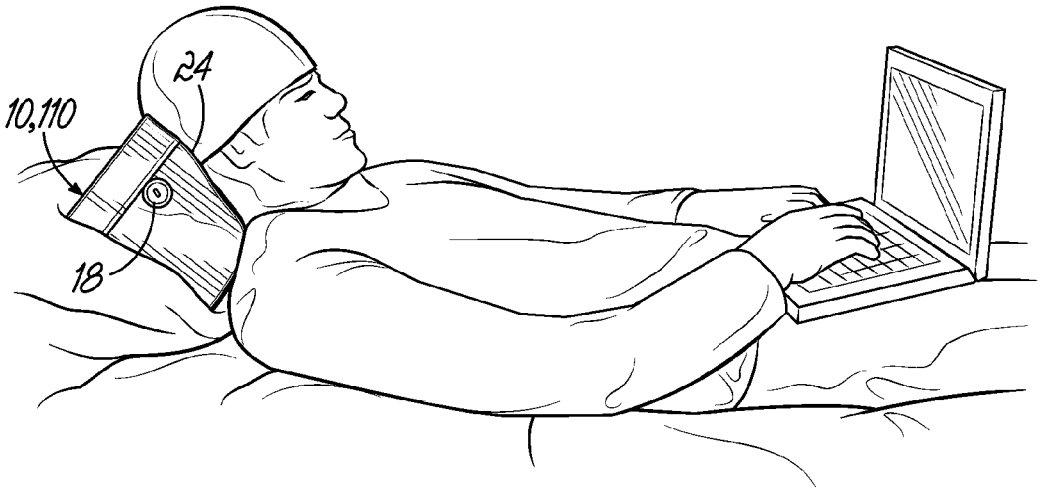
FIG. 7 shows the travel pillow of FIG. 1 in use, supporting the back of the head of a user.
Figure 8:
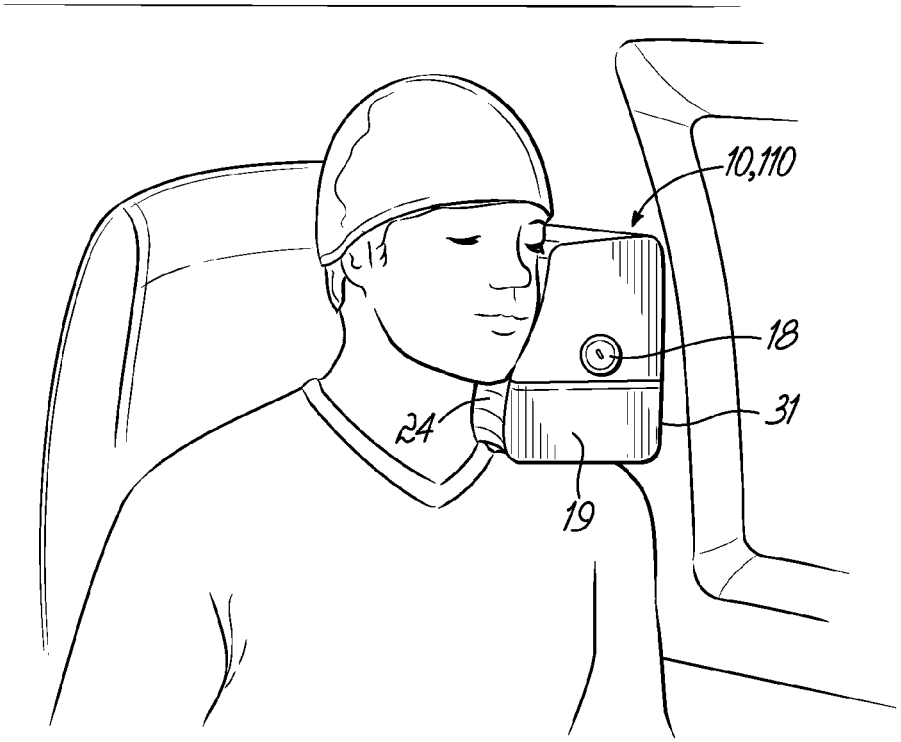
FIG. 8 also shows the travel pillow of FIG. 1 in use, supporting the left side of the head of the user.
Figure 9:
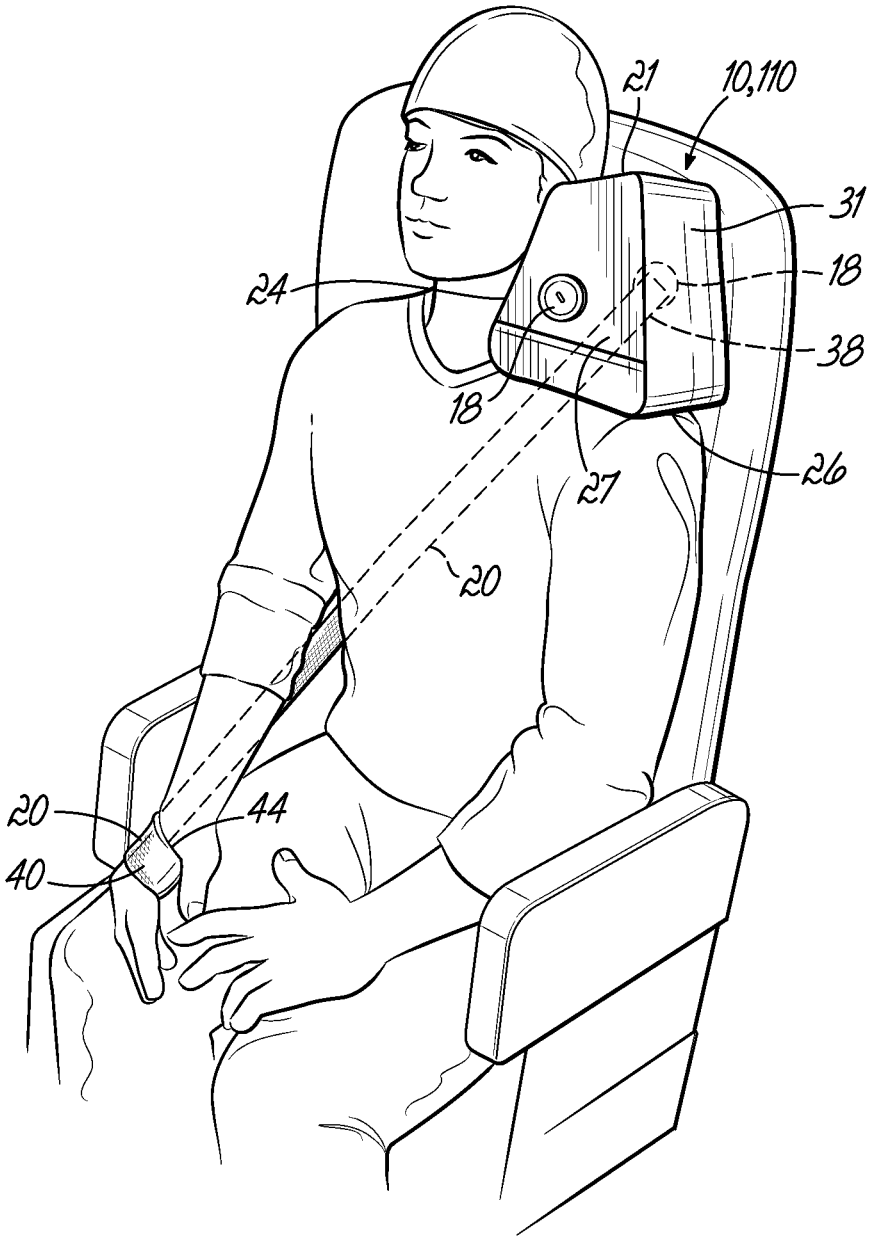
FIG. 9 is similar to FIG. 8, but shows more details of the travel pillow as it supports the head of the user.

FIG. 6-9 show various exemplary uses of the travel pillow 10. For instance, FIG. 6 shows both ends of the strap 20 connected to the pillow 10, and the travel pillow 10 secured to a suitcase. This shows the convenience in carrying the travel pillow 10 on a long trip. Because the strap 20 is adjustable, it can accommodate different sizes of suitcases. FIG. 7 shows another exemplary use of the travel pillow 10, with the outer surface 14 conforming to the back of a user's head and neck, with the user lying on his back. FIG. 8 shows still another exemplary use of the travel pillow 10, on the left shoulder of the user and in contact with the neck and face on the left side. FIG. 9 is similar to FIG. 8, but shows more details of this exemplary use of the travel pillow 10, as explained below.

More particularly, FIG. 9 shows the strap 20 connected to the aft-directed side panel 29, with the strap 20 extending around the torso of the user, between the user's back and the seat, and held in the user's right hand, with no slack. In this manner, the strap 20 pulls on the aft end of the anchor 16, to help hold the pillow 10 in place while the user remains in this position. This relatively straightforward structure enables a user to comfortably rest while travelling, as on a long airplane flight, with comfortable head support. Moreover, the arrangement can be switched to enable head support on the opposite side.

Alternatively, both ends of the strap could be connected to the pillow 10, with the strap 20 completely encircling the user's torso, thereby to produce a similar pulling effect on the anchor 16. Also, the user may adjust the strap adjuster 46 to vary the length of the strap 20, thereby to adapt the travel pillow 10 to different body positions, or even the different shape of another user.

Those skilled in the art will recognize that this written text and these accompanying Figures show merely the currently contemplated preferred embodiments of the present invention, and that the underlying invention is susceptible to reasonable modification depending on a number of factors, including but not limited to the size and shape of the user. Moreover, those skilled in the art will recognize that not every claim of this disclosure is intended to, or required to, provide all of the advantages described herein. Thus, this specification is intended to be exemplary, not restricted, in interpreting the following claims.

I claim:

1. A pillow for advantageous use by a user during travel, comprising:

a pliable three-dimensional body having a shape and size defined by an outer surface, and being conformable to a shoulder of the user, adjacent a head of the user, on either side of the head of the user in a use position;

an anchor having first and second ends and extending through the pliable body from a forward portion to a rearward portion of the outer surface; and a strap having first and second ends, the second end of the strap comprising a length adjuster that defines a loop, the first and second ends of the strap releasably connected to the first and second ends of the anchor, respectively, in a storage position, the first end of the strap releasably connected to one of the first or second ends of the anchor at the rearward portion of the outer surface and the loop of the second end of the strap being configured to be held by a hand of the user in the use position, whereby the strap enables the user to maintain the pliable body in place on the shoulder of the user adjacent the head of the user.

2. The pillow of claim 1, wherein the outer surface of the pliable body comprises at least two concave portions and at least one convex portion, wherein a first concave portion is adapted to contact the shoulder of the user, a second concave portion is adapted to contact a neck of the user, and the convex portion is adapted to contact a face of the user.

3. The pillow of claim 1, wherein each end of the anchor includes a connector adapted to releasably attach to the first end of the strap, thereby to enable the pillow to be used on either shoulder of the user.

4. The pillow of claim 3, wherein each of the connectors comprises a button.

5. The pillow of claim 1, wherein the anchor has substantially the same length as the pliable body when the pliable body is uncompressed.

6. The pillow of claim 1 and further comprising:

an outer encasement defining the outer surface of the pliable member; and an inner core material surrounded by the outer encasement.

7. The pillow of claim 6, wherein the outer encasement includes at least one external pocket.

8. The pillow of claim 6, wherein the outer encasement includes at least one additional securement structure.

9. The pillow of claim 1, wherein the strap comprises an elastic material.

10. The pillow of claim 1, wherein the strap comprises a padded section.

11. The pillow of claim 1 and further comprising:

the pliable member being deflatable and inflatable.

12. The pillow of claim 1, wherein the pliable three-dimensional body further comprises a core, and the anchor extends through the core and is moveable relative thereto.

13. The pillow of claim 12, wherein the anchor comprises a string.

14. A pillow for advantageous use by a user during travel, comprising:

a pliable three-dimensional body having a shape and size defined by an outer surface, and being conformable to a shoulder of the user, adjacent a head of the user, on either side of the head of the user in a use position wherein the user faces a forward direction;

an anchor extending through the pliable body from a forward portion to a rearward portion of the outer surface, the anchor having a longitudinal dimension that is substantially the same as the dimension of the pliable three-dimensional body from the forward portion to the rearward portion when the three-dimensional body is uncompressed, the anchor having opposite outer ends, and each outer end including a connector; and a strap having first and second ends, the second end of the strap defining an adjustable loop, the first and second ends being releasably connected to respective outer ends of the anchor in a storage position, the first end being releasably connectable to one of the outer ends of the anchor at the rearward portion of the outer surface and the adjustable loop on the second end being configured to be held by a hand of the user in the use position, thereby to enable a pulling force to be applied to the anchor by the user's hand via the strap, to maintain the pliable body in place on the shoulder of the user adjacent the head of the user.

15. The pillow of claim 14, wherein the pliable three-dimensional body further comprises a core, and the anchor extends through the core and is moveable relative thereto.

16. The pillow of claim 15, wherein the anchor comprises a string.

17. A method of supporting a user's head while facing a forward direction in a seat comprising:

extending a strap around the back of the user's torso, in front of the seat, such that the strap extends between the back of the user's torso and the seat, with a first end of the strap releasably connected to a rearward facing surface of a three-dimensional pliable body that is residing on and conforming to a shoulder of the user, wherein an anchor extends through the pliable three-dimensional body from the rearward facing surface to the forward facing surface thereof, such that a pulling force applied to the strap causes a corresponding pulling force on the anchor; and holding a second end of the strap away from the shoulder via a hand of the user and in a sufficiently tight manner so as to maintain a pulling force on the strap and on the anchor, thereby to retain the three-dimensional body in position on the shoulder of the user while the user remains in the seat.

18. A pillow for advantageous use by a user during travel, comprising:

a pliable three-dimensional body having a shape and size defined by an outer surface, and adapted to be conformably supported on a shoulder of the user, adjacent a head of the user, on either side of the head of the user when the user is facing in a forward direction;

an anchor having first and second ends and extending through the pliable body from a forward portion to a rearward portion of the outer surface, the anchor extending generally along an axis that is parallel to the forward direction in which the user is facing when the body is conformably supported on the shoulder, adjacent the head; and a strap having first and second ends, at least one of the first and second ends defining an adjustable loop, the first and second ends of the strap being releasably connectable to at least one of the first end of the anchor, the second end of the anchor, or the pliable three-dimensional body when in storage, the first end of the strap releasably connected to one of the ends of the anchor at the rearward portion of the outer surface when in use, whereby the strap enables the user to maintain the pliable body in place on the shoulder of the user adjacent the head of the user by exerting a pulling force on the body via the adjustable loop on the second end of the strap, wherein the second end of the strap may be displaced from the axis during the exerting of the pulling force.

* * * * *